US012331745B2

(12) United States Patent
Rosenbarger

(10) Patent No.: US 12,331,745 B2
(45) Date of Patent: Jun. 17, 2025

(54) 3-DIMENSIONAL PUMP ROTOR PROFILE

(71) Applicant: Boundary Lubrication Systems LLC, Royse City, TX (US)

(72) Inventor: Travis Rosenbarger, Forney, TX (US)

(73) Assignee: Boundary Lubrication Systems LLC, Royse City, TX (US)

( * ) Notice: Subject to any disclaimer, the term of this patent is extended or adjusted under 35 U.S.C. 154(b) by 0 days.

(21) Appl. No.: 18/816,699

(22) Filed: Aug. 27, 2024

(65) Prior Publication Data

US 2024/0418166 A1 Dec. 19, 2024

Related U.S. Application Data

(63) Continuation-in-part of application No. 17/737,474, filed on May 5, 2022, now abandoned.
(Continued)

(51) Int. Cl.
*F04C 2/08* (2006.01)
*F04C 2/10* (2006.01)

(52) U.S. Cl.
CPC ..... *F04C 2/084* (2013.01); *F04C 2/103* (2013.01)

(58) Field of Classification Search
CPC .. F04C 2/084; F04C 2/103; F04C 2/10; F04C 2/088; F04C 2/102; F04C 3/08; F04C 18/16; F04C 18/14; F04C 18/08; F04C 18/22; F04C 2230/10; F04C 2230/21; F04C 2230/25; F04C 2230/60; F04C 2240/20; F04C 2250/20
See application file for complete search history.

(56) References Cited

U.S. PATENT DOCUMENTS 2,601,397 A * 6/1952 Myron ..... F01C 1/103 74/462
3,807,911 A 4/1974 Caffrey
(Continued)

FOREIGN PATENT DOCUMENTS

CN 202946371 U 5/2013
CN 112701863 A 4/2021
(Continued)

OTHER PUBLICATIONS

English Machine Translation of JPH04187883A translated by USPTO Fit Database on Feb. 12, 2024, 1992.
(Continued)

*Primary Examiner* — Dapinder Singh
(74) *Attorney, Agent, or Firm* — GTC Law Group PC & Affiliates

(57) ABSTRACT

A fluid displacement pump having an inner body and an outer body. The inner body includes a first inner lobe profile having a first number of lobes with a first axial extent and a first radial extent; and a second inner lobe profile having the first number of lobes with a second axial extent and a second radial extent. The outer body includes a first outer lobe provide and a second outer lobe profile. The first outer lobe profile has a second number of lobes configured to engage with the first inner lobe profile. The second outer lobe profile has the second number of lobes configured to engage with the second inner lobe profile, where the second outer lobe profile is axially coextensive with the second inner lobe profile.

20 Claims, 12 Drawing Sheets

Related U.S. Application Data

(60) Provisional application No. 63/184,554, filed on May 5, 2021.

(56) References Cited

U.S. PATENT DOCUMENTS

| | | | | |
|---|---|---|---|---|
| 7,819,645 | B2 * | 10/2010 | Hosono | F04C 2/102 418/150 |
| 8,096,795 | B2 * | 1/2012 | Ono | F04C 2/102 418/61.3 |
| 8,632,323 | B2 * | 1/2014 | Uozumi | F04C 2/084 74/462 |
| 9,541,085 | B2 * | 1/2017 | Uozumi | F04C 2/102 |
| 9,574,559 | B2 * | 2/2017 | Shiotani | F04C 2/084 |
| 2005/0063851 | A1 * | 3/2005 | Phillips | F04C 2/086 418/61.3 |
| 2018/0023561 | A1 | 1/2018 | Rossi | |
| 2019/0070664 | A1 | 3/2019 | Paniogue et al. | |
| 2020/0300243 | A1 | 9/2020 | Rosenbarger | |
| 2022/0356876 | A1 | 11/2022 | Rosenbarger | |

FOREIGN PATENT DOCUMENTS

| | | | |
|---|---|---|---|
| EP | 1550542 | A1 | 7/2005 |
| JP | H04187883 | A | 7/1992 |
| KR | 101869874 | B1 | 6/2018 |

OTHER PUBLICATIONS

English Machine Translation of CN202946371U translated by USPTO Fit Database on Feb. 12, 2024, 2013.

* cited by examiner

3-DIMENSIONAL PUMP ROTOR PROFILE

CROSS-REFERENCE TO RELATED APPLICATIONS

The present application is a continuation-in-part (CIP) of and claims priority to U.S. non-provisional patent application Ser. No. 17/737,474, 5 May 2022, and entitled "3-DIMENSIONAL PUMP ROTOR PROFILE", published as U.S. 2022/0356876 A1 on 10 Nov. 2022.

U.S. non-provisional patent application Ser. No. 17/737,474 claims the benefit of priority to U.S. provisional application Ser. No. 63/184,554, filed on 5 May 2021, and entitled "WEDGE ROTOR AND DUAL WEDGE ROTOR UNIQUE 3-DIMENSIONAL PUMP PROFILES".

The above patent applications are incorporated herein by reference in their entirety for all purposes.

BACKGROUND

Presently known gerotor pumps have a number of challenges. Most applications of a gerotor pump have a strong preference for a fixed footprint for the pump, for example applications where the pump is provided as a replacement part, an aftermarket part, and/or a part that is utilized over multiple model years (e.g., of a vehicle), where continuity in the volumetric footprint of the pump is highly desirable to maintain continuity of the system design. However, within that fixed footprint, there is often a need or desire to increase the throughput of the pump, for example to produce a system with a higher power rating that may require a greater flow rate burden for the pump.

Further, it is desirable to produce a pump that is capable to be manufactured with standard machining equipment. For example, almost any design can be accommodated by a manufacturing technique such as a 3-D printing technique. However, 3-D printing in the present state of the technology greatly increases the manufacturing expense for many parts, and presently has limits in the final strength of the manufactured part. While it is desirable for a gerotor pump to be manufacturable with standard machining equipment, aspects of the present disclosure are nevertheless beneficial even for a 3-D printed part, and 3-D printing technology will continue to improve in both increased capability and reduced cost. Accordingly, the benefits of the present disclosure are applicable to both gerotor pumps manufactured using standard machining operations or 3-D printing operations.

SUMMARY

An example apparatus includes an outer rotor having a first axial face and a second axial face opposite the first axial face, wherein the first axial face comprises a circumferential contour defining a plurality of lobe faces, and wherein the second axial face comprises a transformed circumferential contour defining a corresponding plurality of lobe faces, where the transformed circumferential contour comprises at least one of a scale transformation of the circumferential contour or a rotational transformation of the circumferential contour; and an inner rotor configured to rotate eccentrically within the outer rotor, thereby forming a gerotor element for a fluid pump.

Certain further aspects of the example apparatus are described following, any one or more of which may be present in certain embodiments. An example transformation circumferential contour includes the scale transformation, where the scale includes a value between 1.01 to 1.10, between 1.01 to 1.30, and/or between 0.70 and 1.50, inclusive. An example transformation circumferential contour includes the rotational transformation, where the rotation includes a value between 1° and 10°, between 1° and 30°, and/or between 5° and 60°, inclusive.

An example method includes an operation to prepare an outer rotor having a first axial face and a second axial face opposite the first axial face, where the first axial face includes a circumferential contour defining a number of lobe faces, where the second axial face includes a transformed circumferential contour defining a corresponding number of lobe faces, and an operation to prepare an inner rotor configured to rotate eccentrically within the outer rotor, thereby forming a gerotor element for a fluid pump.

Certain further aspects of the example method are described following, any one or more of which may be present in certain embodiments. An example method includes preparing the outer rotor by machining an outer rotor blank in response to the transformed circumferential contour. An example method includes preparing the inner rotor by machining an inner rotor blank configured to rotate eccentrically within the outer rotor, thereby forming a gerotor element for a fluid pump. An example method includes performing the machining by applying a rotational transformation and/or a scale transformation of the circumferential contour. An example method includes preparing an outer rotor blank and/or an inner rotor blank each as a cast and/or a forged blank. An example method includes preparing the inner rotor with matching lobe contours to the outer rotor.

An example pump assembly includes an inner element/body and an outer element/body, where the inner element and outer element are configured to rotationally engage thereby forming a number of dynamically changing pumping volumes, where at least one of the inner element or the outer element includes a rotor (e.g., where the other one of the inner element or the outer element includes a rotor or a stator), and where a major diameter of the rotational engagement between the inner element and the outer element includes a Z-axis variability.

Certain further aspects of the example pump assembly are described following, any one or more of which may be present in certain embodiments. An example pump assembly includes the Z-axis variability as a rotational variability and/or a scaling variability. An example scale variability includes a scale value between 1.01 to 1.10, between 1.01 to 1.30, and/or between 0.70 and 1.50, inclusive. An example rotational variability includes a rotation value between 1° and 10°, between 1° and 30°, and/or between 5° and 60°, inclusive.

DETAILED DESCRIPTION

Figure 1:
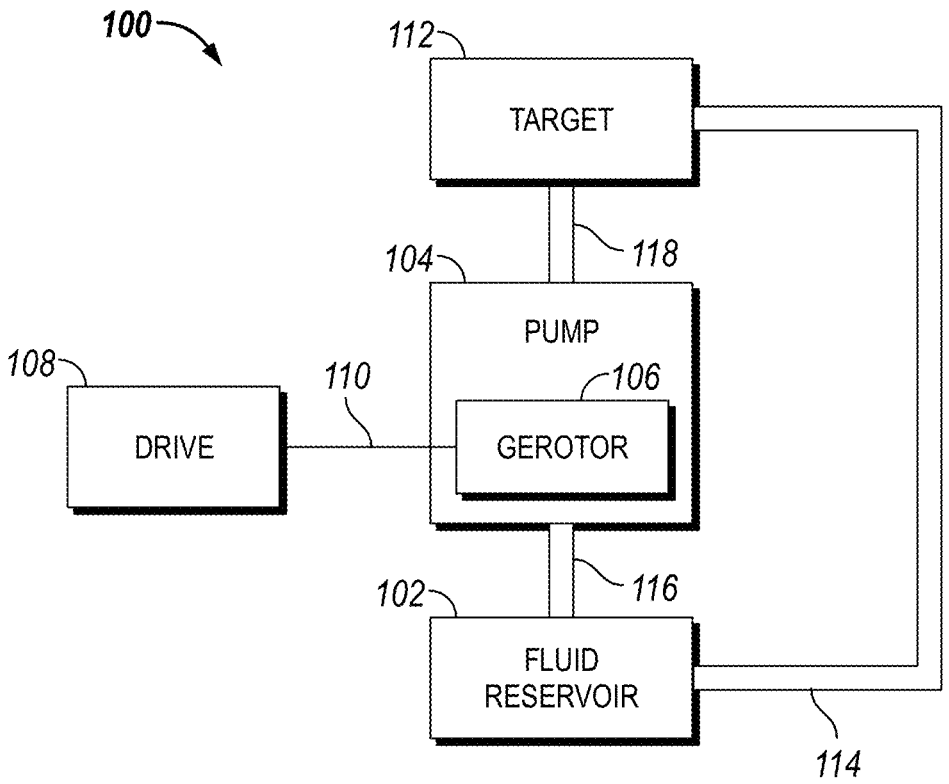
FIG. 1 is a schematic diagram of a system including a gerotor pump, in accordance with embodiments of the current disclosure.

For the purpose of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Throughout the present disclosure, an inner element/body of the gerotor pump is referenced as an inner rotor, and an outer element/body of the gerotor pump is referenced as an outer rotor. It is possible to make a gerotor pump where the inner element/body is a stator, or where the outer element/body is a stator. Applications of the gerotor pump with the inner element/body or outer element/body as a stator are explicitly contemplated herein, but for clarity of the description, both elements/bodies will be referenced as a rotor herein.

The rotors herein are applicable to a gerotor pump, or an internal gear pump. Such pumps utilize an inner rotor having a number of teeth or lobes, interacting with matching recesses (formed by complementary teeth or lobes on the outer rotor) on an outer rotor to dynamically form pressure chambers, and pressurize the fluid within. Generally, the outer rotor has one more recess (or tooth/lobe) than the inner rotor. The inner rotor rotates on an eccentric axis relative to the outer rotor, sequentially forming the pressure chambers around the circumference of the outer rotor. The fluid may be expelled axially or radially, depending on the specific pump design and where fluid openings are arranged. The rotor designs herein are usable in a gerotor pump or an internal gear pump according to any design, and the specifics of the overall pump design are omitted to highlight the aspects of the present disclosure.

The available fluid volume deliverable by a gerotor pump is constrained by the individual chamber volumes formed by the pump as the rotors rotate relative to each other, and the rotational speed available for the pump. The rotational speed of the pump is limited by the strength of parts, the speed limits and/or power limits of the driving motor for the pump, and the dynamic pressure capability of the pump as the fluid responds to high pump velocities, ultimately limited due to cavitation, fluid viscosity response to high shear, or the like. Further, rotational speeds may be limited due to NVH (noise, vibration, and harshness) constraints for the system—for example limiting sound volumes and/or sound frequencies due to operator acceptability limits. Accordingly, previously known systems are generally limited to increasing the pump size, and consequently the pump footprint, to increase the volumetric flow rate capability of the pump.

In addition to a high value on footprint consistency, many applications are constrained in overall size of components thereon, including fluid pumps. For example, automotive and aerospace applications have limited space for components, and significant limitation on weight requirements for components. Accordingly, many applications have a strong incentive to minimize the size and/or weight of components, and/or hard limits on the maximum size and/or weight of components. Accordingly, many applications have significant pressure to increase the performance capability of components within a given weight and/or volume, and/or to increase the specific performance of components per unit of weight and/or volume.

Aspects of the present disclosure greatly improve the volumetric flow capability of the pump, primarily by increasing the maximum intake volume of each dynamically formed chamber of the pump. Further, aspects of the present disclosure increase the volumetric efficiency of the pump, by providing increased chamber shaping control that can limit the maximum dynamic pressures in the chamber, and conform the lobes and recesses of the inner and outer rotors. Improvements to the volumetric efficiency result in increases to the effective fluid volume delivery, and lower pumping losses for a given fluid delivery performance.

Embodiments of the present disclosure are set forth in the context of a fluid operated on by the pump—for example with the pump pressurizing the fluid, and driven by an external power source such as an electric motor, mechanical coupling, or the like, and/or with the pump powering another device, accepting pressurized fluid and powering a shaft or other coupling to a load. A fluid, as utilized herein, should be understood broadly, and includes at least any liquid, gas, colloid or colloidal suspension, fluids having suspended or entrained solids, emulsion, or the like.

Referencing FIG. 1, an example system 100 including a gerotor pump is schematically depicted. The example system 100 includes the pump 104, for example a housing that contains the gerotor 106 (e.g., the inner and outer rotor), ports for fluid inlet and outlet, or the like. In the example, fluid intake 116 delivers fluid to the pump 104, and fluid exhaust 118 delivers pressurized fluid to the target 112. The pump 104 may be any type of gerotor and/or internal gear pump as known in the art, with the aspects of the rotors as set forth herein. The system 100 includes a drive 108 coupled to the rotor(s) to drive one or both of the rotors, for example using a shaft 110 to couple the drive to the rotor(s). The example of FIG. 1 includes a fluid reservoir 102, with recycled fluid 114 from the load (target 112), for example in a hydraulic system, power steering system, certain fuel systems, or the like. The example of FIG. 1 is non-limiting, for example the fluid may be provided to a target 112 without recycling to the pump, depending upon the application. Additionally or alternatively, the fluid reservoir may instead be an intake stream, either unrelated to a fluid reservoir, or with a fluid reservoir that is positioned outside the system. The example of FIG. 1 depicts an illustrative context for the gerotor 106, but is not limiting to the present disclosure.

The example of FIG. 1 is described in the context of the pump 104 operating as a pump, and receiving power from a drive 108. The aspects of the present disclosure are equally applicable to the pump 104 acting as a power generator, for example driving a load (e.g., logically positioned at the location of the drive 108), and utilizing working fluid pressure to power the load. Any such embodiments are explicitly contemplated herein.

Figure 2:
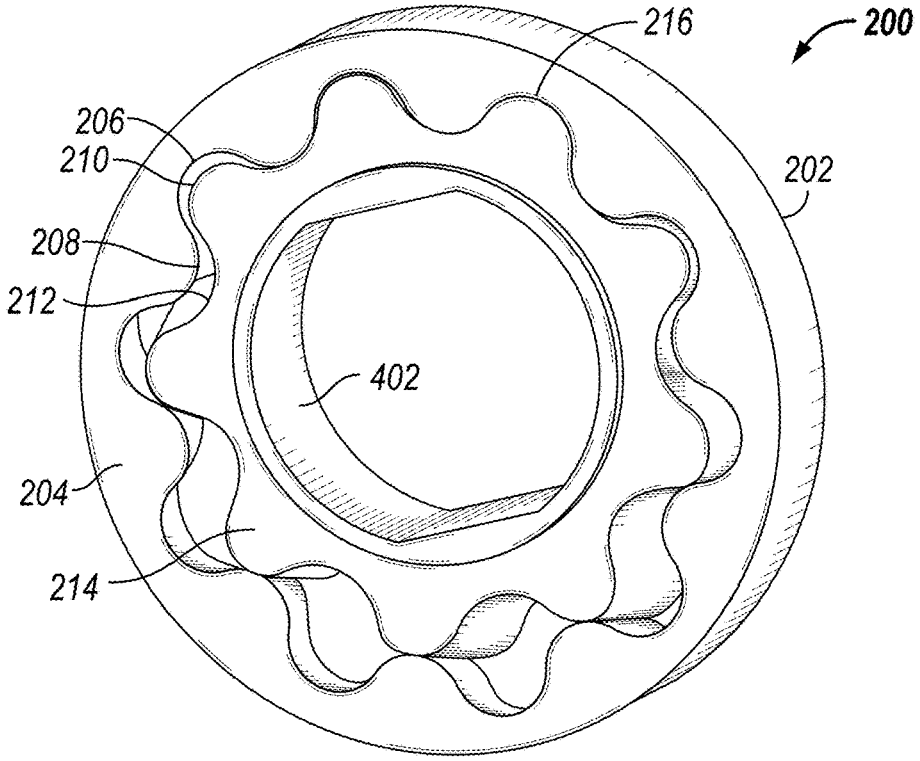
FIG. 2 is a first axial face perspective view of an inner rotor and an outer rotor of a gerotor component, in accordance with embodiments of the current disclosure.

Referencing FIG. 2, an example gerotor component 200 is depicted, having an inner rotor 216, an outer rotor 202, and an engagement collar 402 allowing the pump to mechanically engage an external drive or load. The engagement collar 402 is a non-limiting example, with external engagement features formed on the rotor directly (e.g., reference FIG. 3), or through any other arrangement. In the example of FIG. 2, an axial face 204 of the outer rotor 202 is depicted, and which is bounded by a circumferential contour 206 defining a number of lobes (e.g., at location 208) or recesses (e.g., at location 206) that interact with lobes and recesses of the inner rotor 216 to sequentially form fluid chambers, pressurizing the fluid to be expelled as a pressurized fluid, and/or accepting pressure from the fluid to provide mechanical energy to a load (e.g., expelling the fluid at a lower pressure than at the inlet). The housing of the gerotor utilizing the gerotor component 200 includes ports arranged at appropriate locations to provide fluid inlet and outlet functions, as is known in the art. In the example of FIG. 2, the inner rotor 216 includes lobes 210 and recesses 212 that interact with the outer rotor 202 lobes and recesses, with tip engagement of each rotor interacting to seal the sequentially formed chambers and support pumping operations. In the example of FIG. 2, the inner rotor 216 includes one less lobe than the outer rotor 202 (e.g., 9 lobes on the inner rotor versus 10 lobes on the outer rotor, in the example), where the inner rotor 216 rotates on an eccentric axis relative to the outer rotor, which is an arrangement generally understood for gerotors and/or internal gear pumps.

Figure 3:
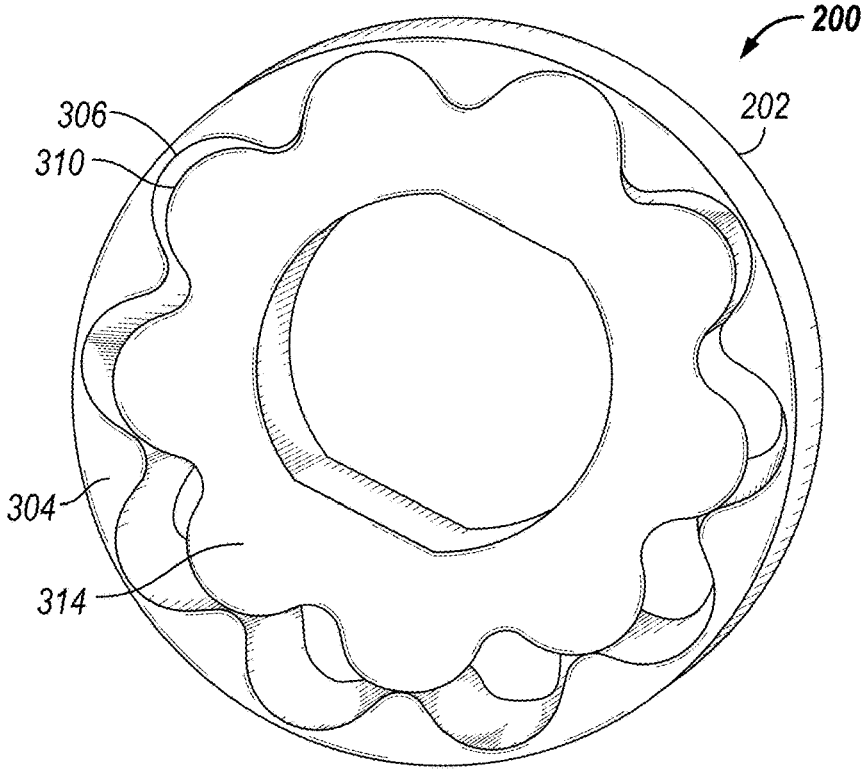
FIG. 3 is a second axial face perspective view of an inner rotor and an outer rotor of a gerotor component, in accordance with embodiments of the current disclosure.

Referencing FIG. 3, an example gerotor component 200 is depicted, which is consistent with aspects of the embodiment of FIG. 2, viewed from the opposite axial face 304 of the outer rotor 202 relative to the axial face 214 visible in the example of FIG. 2. To illustrate some variability that may be present in certain embodiments, the embodiment of FIG. 2 is depicted with an engagement collar 402, and the embodiment of FIG. 3 is depicted without an engagement collar 402. In the example of FIG. 3, the circumferential contour 306 of the second axial face 304 is scaled relative to the axial face 204 on the other side of the outer rotor 202. The scaling of the axial face 304 results in a thinner outer wall for the outer rotor 202, but in combination with the thicker wall on the first side of the outer rotor 202 and the progressing wall thickness of the outer rotor 202 in the Z direction (e.g., a centerline axis perpendicular to the axial face) nevertheless provides for sufficient mechanical integrity of the gerotor component 200. The example scaling of the second axial face 304 relative to the first axial face 204 provides for a greater fluid volume in each chamber, as well as a higher compression ratio capability (e.g., depending upon the positioning of the fluid inlet and outlet ports) for the pump due to the greater difference between minimum and maximum volumes of each chamber.

The example of FIGS. 2 and 3 includes a conforming configuration of the lobes and recesses of the inner rotor, for example matching the scaling transformation between the axial faces 204, 304 of the outer rotor. In certain embodiments, a rotational transformation may be applied, additionally or alternatively, to the axial faces 204, 304, which would also be matched by the inner rotor configuration. The inner rotor geometry match to the outer rotor is an operational match, for example with an arrangement to provide the selected chamber geometry, sealing capability, and the like, with other slight differences due to the distinct number of lobes on each rotor. The example of FIG. 3 includes lobes 310 of the inner rotor defined on the axial face 314 of the inner rotor, and engaging recesses 306 of the outer rotor. Accordingly, the description herein stating that the inner rotor matches the outer rotor, that the inner rotor is configured to form a gerotor element for a fluid pump, or the like, indicates that the inner rotor is configured with sufficient matching to the outer rotor to perform the selected pumping operations. The modifications to the inner rotor relative to the configuration of the outer rotor is well understood to one of skill in the art having the benefit of the present disclosure, and are not further set forth herein. In certain embodiments, the shape of the contour lines, e.g., lobe profiles, 206, 306 may form a trochoid, and/or a modified trochoid, as will be understood by one of skill in the art.

Figure 4:
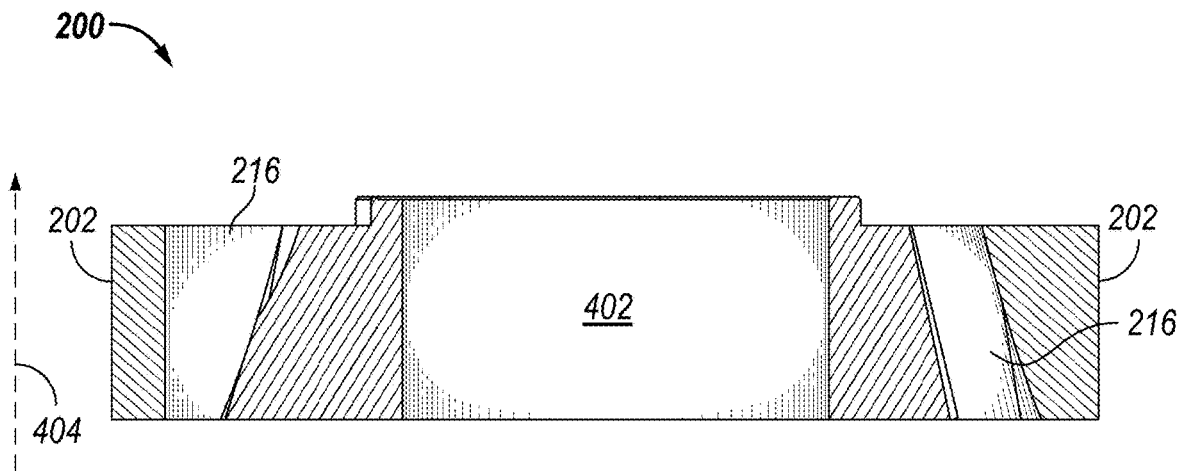
FIG. 4 is a schematic cutaway view of a gerotor component, in accordance with embodiments of the current disclosure.

Referencing FIG. 4, an example partial cutaway view of a gerotor component 200 is depicted. The example cutaway view shows the outer rotor 202, the inner rotor 216, and the engagement collar 402. The contact positions between the rotors 202, 216 provide scaling for the fluid chambers, with gap areas (e.g., on the right side between the rotors 202, 216) acting as the fluid chambers. The example of FIG. 4 depicts an illustrative Z-axis 404 notation, showing an example Z direction for the gerotor component 200. For example, Z-axis variability of the major diameter (or effective diameter, maximum diameter, and/or base circle) of the inner rotor and/or the outer rotor in the Z-axis indicates that the cross section of the rotor varies, e.g., extends, in the Z-axis 404 direction, for example in response to the scaling transformation and/or the rotational transformation.

Figure 5:
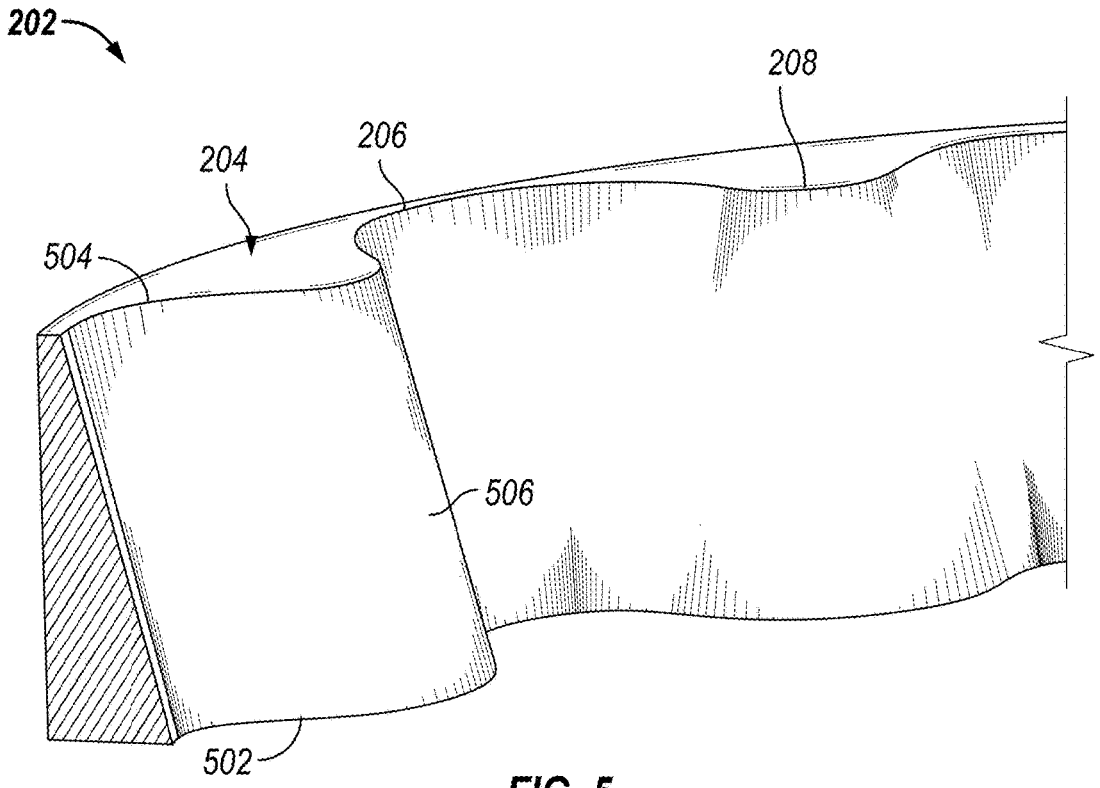
FIG. 5 is a partial cutaway view of an outer rotor, in accordance with embodiments of the current disclosure.

Referencing FIG. 5, an example partial cutaway view of an outer rotor 202 is depicted. The example outer rotor 202 depicts a portion of the axial face 204, with circumferential contour lines 502, 504 defining each corresponding axial face of the outer rotor 202. The outer rotor 202 thereby forms a number of lobes 506, which are the geometrical volume formed between the lobe faces of each of the axial faces of the outer rotor 202. The lobe 506 in the example expands in the Z direction (going down, in the example of FIG. 5), due to the scaling of circumferential contour line 502 relative to circumferential contour line 504, and consequent changes in the axial faces on each side of the outer rotor 202.

Figure 6:
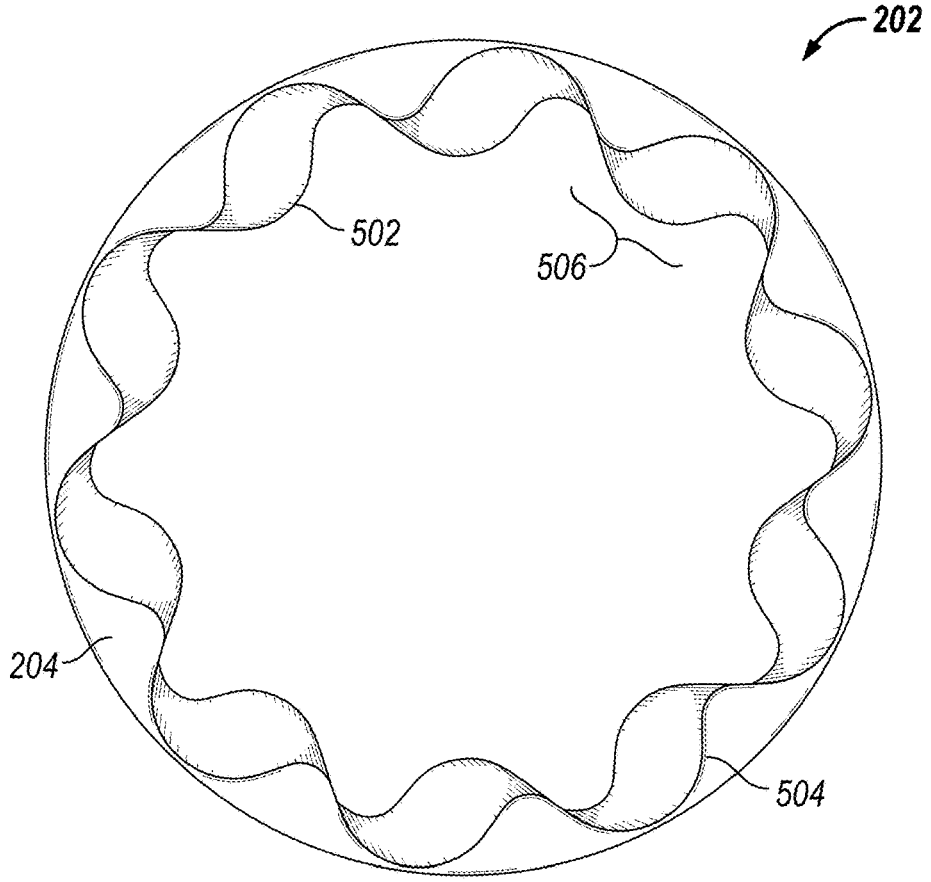
FIG. 6 is a top view of an outer rotor, in accordance with embodiments of the current disclosure.
Figure 7:
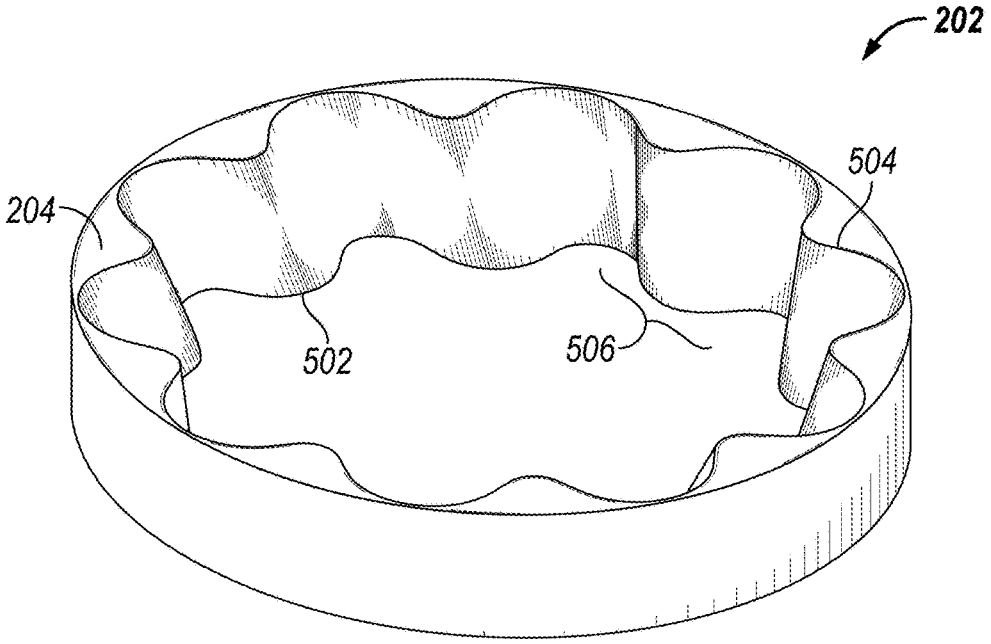
FIG. 7 is a perspective view of an outer rotor, in accordance with embodiments of the current disclosure.

Referencing FIG. 6, an example outer rotor 202 is depicted, having a second circumferential contour line 504 that is both scaled and rotated relative to circumferential contour line 502. The scaling may be utilized to increase the chamber volumes and/or volume ratios, while maintaining sufficient mechanical integrity of the rotor 202. The rotation may be utilized to adjust the chamber volumes—for example by increasing the volume of a given chamber (e.g., adding a diagonal aspect to the lobe 506 and resulting chamber(s)), providing for enhanced utilization of gerotor geometric footprint for fluid retention, and/or adjusting the mechanical stress profile of the rotor 202 (e.g., due to varying wall thickness of the outer rotor, utilization of the lobes 506 as a part of the supporting structure, e.g., as ribs providing some radial stress support, or the like). Additionally or alternatively, the rotation may be utilized to enhance sealing, for example providing for a greater sealing surface area, a better matching of rotor edges for sealing, changes to the orientation of the seal, and/or a surface for machining operations to enhance sealing of fluid chambers during operations of the pump. In certain embodiments, the utilization of a rotational transformation allows for reduced leakage from fluid chambers during operations of the pump, including a reduction of leakage to effectively zero leakage. Accordingly, the utilization of a rotational transformation also enhances volumetric efficiency of operating pump. Referencing FIG. 7, an example outer rotor 202 is depicted in a perspective view. The example of FIG. 7 is consistent with the example of FIG. 6.

Figure 8:
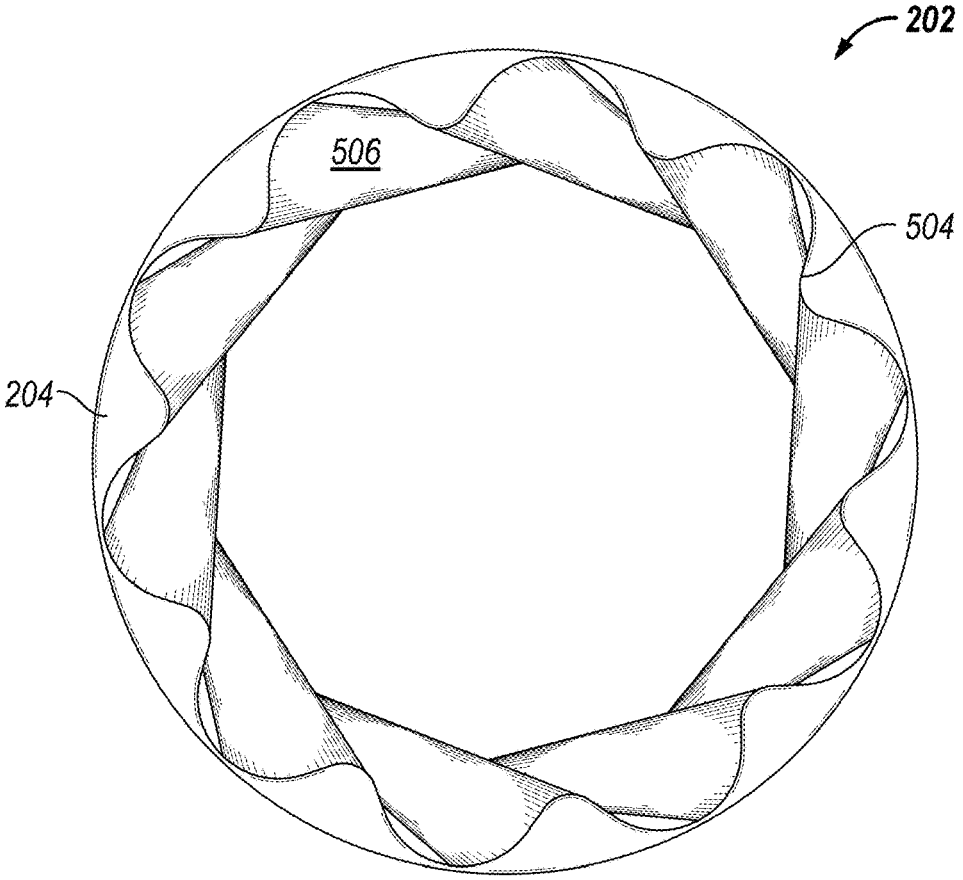
FIG. 8 is a top view of an outer rotor with a high rotational transformation, in accordance with embodiments of the current disclosure.
Figure 9:
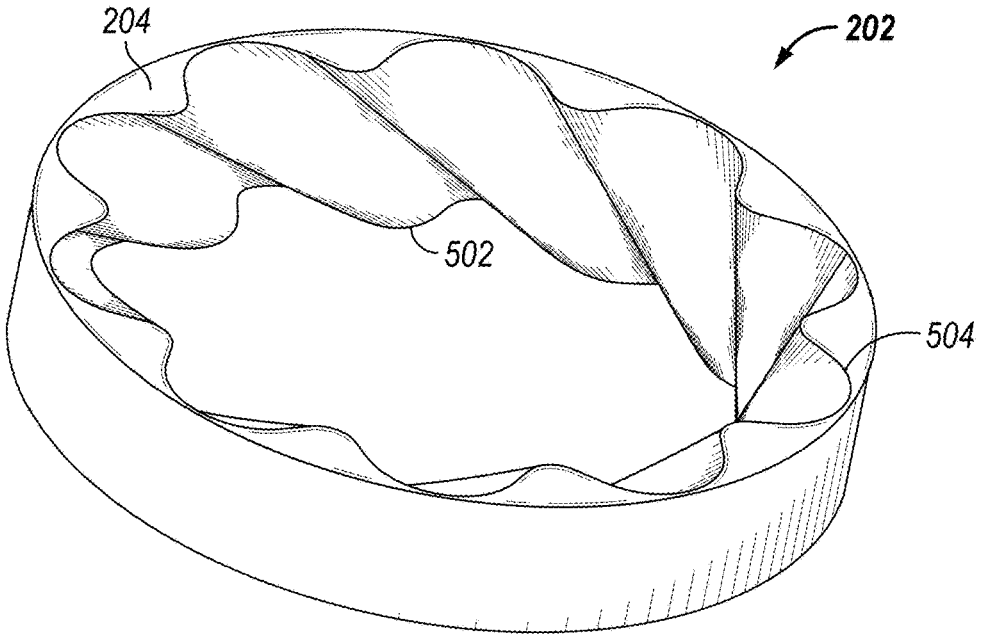
FIG. 9 is a perspective view of an outer rotor with a high rotational transformation, in accordance with embodiments of the current disclosure.

Referencing FIG. 8, an example outer rotor 202 is depicted in a top view, where the example outer rotor 202 includes a high rotational transformation angle. The example of FIG. 8 is not limiting, and not necessarily depicted according to scale, but nominally depicts a rotational transformation of about 60°. The actual angle of the rotational angle may be defined or determined in any manner, for example determined according to a rotational difference between a feature of the first axial face 502 and a corresponding feature of the second axial face 504—for example a lobe face position, recess position, or the like. The rotational transformation angle, where present, may be any value available according to the geometry of the outer rotor 202 (e.g., the Z-axis thickness/extent of the rotor, the diameter of the rotor, and/or the radial thickness of the rotor), the desired purpose of the rotation (e.g., chamber volume control, mechanical stress control, and/or volumetric efficiency control), or the like. It will be seen that higher angles may introduce design complexity, increase manufacturing difficulty, and/or may not be possible depending upon the rotor size, number of lobes, etc. Embodiments herein may be varied from a 0° rotation (e.g., no rotational transformation applied) to about 60° rotation. In certain embodiments, even greater rotational transformation angles may be utilized, including up to about 70° rotation, 80° rotation, or 90° rotation. Referencing FIG. 9, an example outer rotor 202 having a high rotational transformation angle is depicted in a perspective view, consistent with the example of FIG. 8. The example of FIGS. 8 and 9 further include a scaling transformation. A given gerotor component may be formed with an outer rotor having a scaling transformation, a rotational transformation, or both.

Figure 10:
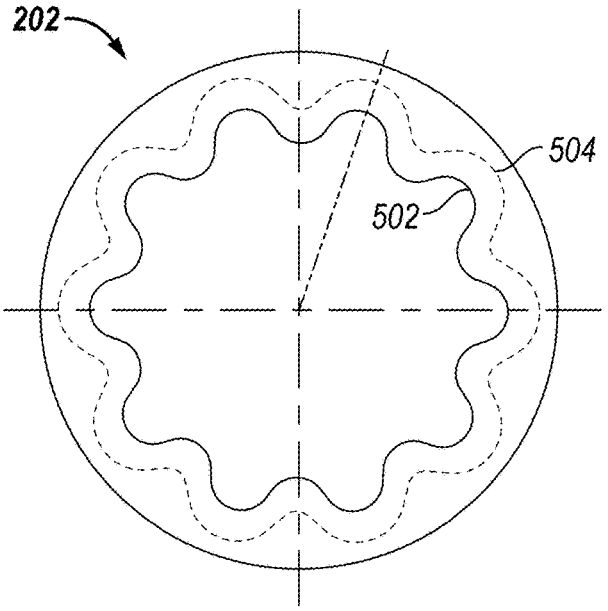
FIG. 10 is a schematic view depicting aspects of a scaling transformation, in accordance with embodiments of the current disclosure.

Referencing FIG. 10, an example outer rotor 202 is depicted schematically in a partially transparent view. The example outer rotor 202 includes a scaling transformation, for example where the circumferential contour 502 for a first axial face is scaled relative to the circumferential contour 504 for the second axial face. The scaling in the example may be normalized according to the smaller contour, for example where the scaling factor is normalized to be a value equal to or greater than one (1). The scaling available for a given outer rotor 202 depends upon a number of factors, including at least: the desired chamber volume(s) and/or volume ratios; the Z-axis thickness of the rotor; the radial thickness of the rotor (e.g., including the resulting variations thereof due to the scaling transformation); the diameter of the rotor; and/or the chamber volume and/or geometry encompassed by the chambers (e.g., based upon the stresses and/or forces present at operating pressures). In certain embodiments, a scaling factor of between about 1.0 (e.g., where no scaling transformation is applied) to about 1.10 provides for significant flexibility in the pump capability, and encompasses numerous benefits of the present disclosure. The scaling factor may be any value, such as up to about 1.30, up to about 1.50, or the like. The scaling factor may be limited at the high end by certain considerations, such as manufacturability of the design, complications in sealing between the inner rotor and the outer rotor, diminishing returns in chamber volume enhancement, minimum wall thickness of the outer rotor at the scaled axial face (e.g., the axial face corresponding to circumferential contour 504, in the example of FIG. 10), or the like. The limit of the scaling factor for a particular design, whether an engineering limit or a commercial value limit, will depend on the characteristics of the particular system, and will be readily determinable to one of skill in the art having the benefit of the present disclosure. The scaling factor, as utilized herein, references the ratio between the diameters of corresponding aspects of the circumferential contour lines 502, 504, for example at a lobe position, recess position, or the like. In certain embodiments, the scaling factor may be related to another aspect, such as the encompassed area within a given contour, or other similar geometric parameters. Any such conceptions of the scaling factor are contemplated herein, and the recited scaling factors would be adjusted accordingly (e.g., a diameter based scaling factor of 1.2 may equate to an area-based scaling factor of 1.44, depending upon the specific geometry of the rotor and contour line(s)). In certain embodiments, including for certain applications, materials for the outer rotor, low pressure applications, or the like, a high scaling factor such as 1.70, 2.0, or higher, may be utilized. The example scaling factors set forth herein may be utilized in a broad range of applications, including varying rotor materials, rotor geometries, fluid compositions, pressure ratings, or the like.

Figure 11:
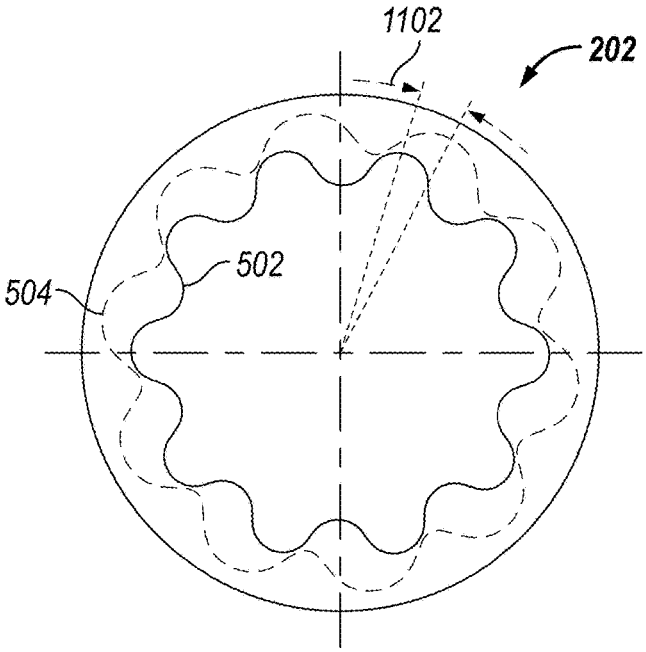
FIG. 11 is a schematic view depicting aspects of a scaling and rotational transformation, in accordance with embodiments of the current disclosure.
Figure 12:
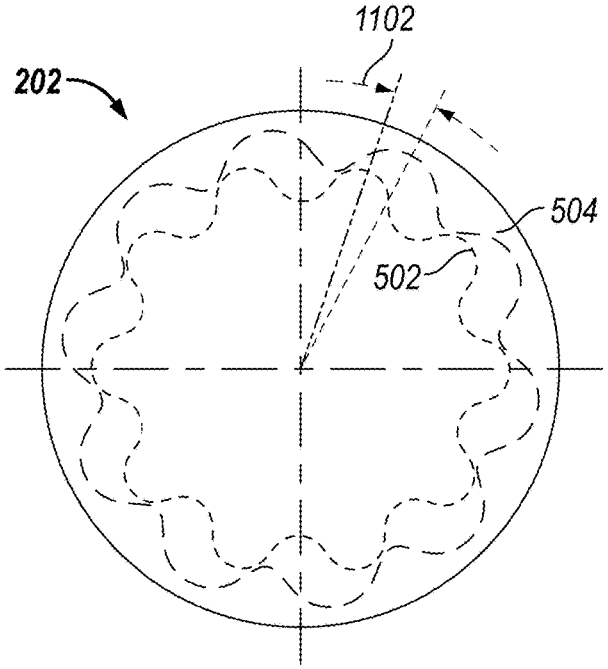
FIG. 12 is a schematic view depicting aspects of a scaling and rotational transformation, in accordance with embodiments of the current disclosure.

Referencing FIG. 11, an example outer rotor 202 is depicted schematically in a partially transparent view. The example outer rotor 202 includes a scaling transformation, for example where the circumferential contour 502 for a first axial face is scaled relative to the circumferential contour 504 for the second axial face, and a rotational transformation, for example where the circumferential contour 502 is rotated relative to the circumferential contour 504. The example of FIG. 11 depicts a rotational angle 1102 to illustrate the rotation present in the example, which is depicted at about 10 degrees of rotation in the un-scaled illustration of FIG. 11. Referencing FIG. 12, an example outer rotor 202 is depicted, again with both a rotational and scaling transformation, and with a rotational angle 1102 of about 8 degrees in the un-scaled illustration of FIG. 12. The examples of FIGS. 11 and 12 are illustrative to depict certain aspects of the disclosure, and to provide a context for depicting scaling and rotation as set forth herein, but are not limiting to the available range of transformations consistent with embodiments of the present disclosure.

Figure 13:
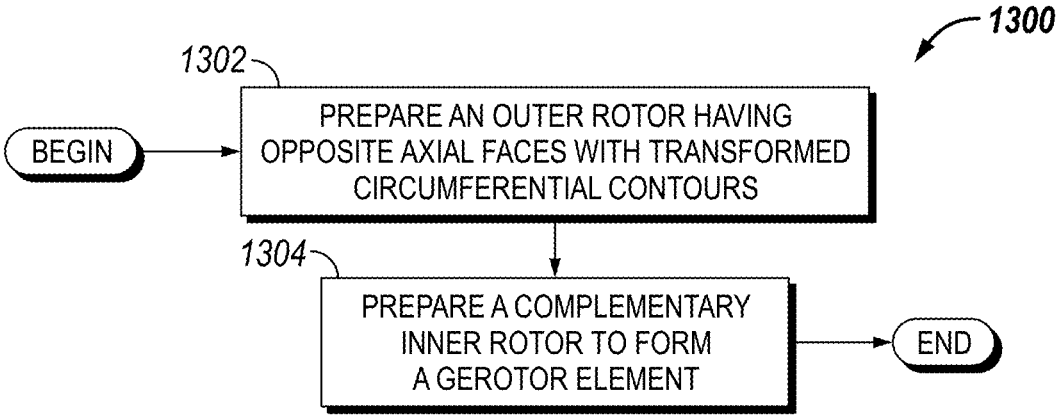
FIG. 13 is a schematic flow diagram of a procedure to manufacture a gerotor component, in accordance with embodiments of the current disclosure.

Referencing FIG. 13, an example procedure 1300 for manufacturing a gerotor element, for example an inner rotor and an outer rotor to be utilized in a gerotor pump, is schematically depicted. The example procedure 1300 includes an operation 1302 to prepare an outer rotor having a first axial face and a second axial face opposite the first axial face, where each axial face includes a circumferential contour defining lobe faces thereon, and where the second axial face includes a transformed circumferential contour relative to the circumferential contour of the first axial face. The transformed circumferential contour may be a scaling transformation and/or a rotational transformation, as set forth throughout the present disclosure. The example procedure 1300 further includes an operation 1304 to prepare a complementary inner rotor to form, in combination with the outer rotor, a gerotor element (or gerotor component). In certain embodiments, a complementary inner rotor includes a geometry, lobe arrangement, and the like, such that the inner rotor may be utilized with the outer rotor in a gerotor pump and/or inner gear pump. Any aspects of the inner rotor as set forth throughout the present disclosure are applicable to the procedure 1300 and operation 1304.

Figure 14:
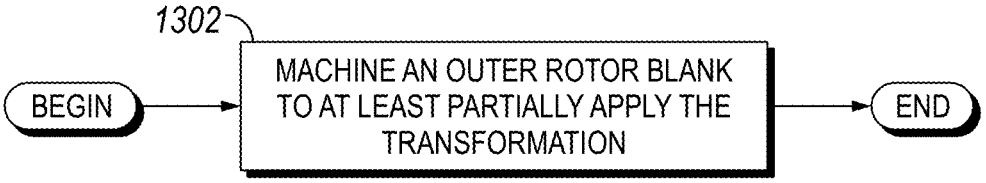
FIG. 14 is a schematic flow diagram of a procedure to prepare an outer rotor, in accordance with embodiments of the current disclosure.

Referencing FIG. 14, an example operation 1302 to prepare the outer rotor includes an operation to machine an outer rotor blank to at least partially apply the transformation. The outer rotor blank, where applicable, may be any type of precursor to the outer rotor, where machining operations are applied to form the final geometry of the rotor. For example, the blank may be a billet or other simple geometry component having sufficient material and geometry to define the outer rotor, where machining operations remove material to complete the formation of the outer rotor. In certain embodiments, the blank may be a cast component, a near net component, or the like. In certain embodiments, the blank may be cast, forged, a sintered substrate, or the like. Embodiments herein utilizing rotational and/or scaled transformations are manufacturable with ordinary machining operations, as such embodiments provide tool accessibility and line-of-sight consistent with ordinary machining capability. Example machining operations capable of producing rotors herein include, without limitation, drilling, grinding, milling, lathing, or the like. In certain embodiments, a 3-axis machine may be utilized, but for even complex configurations herein, a machine having 6-axis capability will be generally sufficient for machining operations without extensive handling, arranging, or the like with the workpiece.

Figure 15:
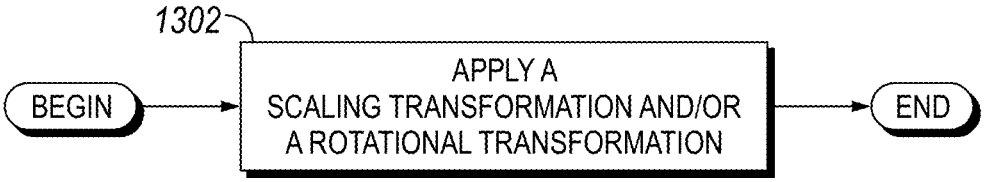
FIG. 15 is a schematic flow diagram of a procedure to prepare an outer rotor, in accordance with embodiments of the current disclosure.

Referencing FIG. 15, an example operation 1302 to prepare the outer rotor includes an operation to apply a scaling transformation and/or a rotational transformation to the workpiece to generate the outer rotor. The application of the scaling and/or rotational transformations may be performed, in part, by the preparation of the blank, and/or may be applied completely or in part by machining operations. The example operations of FIGS. 14 and 15, including the utilization of a blank and subsequent machining, are equally applicable to the inner rotor. The capability to form the rotors utilizing ordinary machining operations of moderate complexity provides for a number of benefits, including reduction in manufacturing cost, ready confirmation that the part has been manufactured properly, and the like. In certain embodiments, additive manufacturing may be utilized to create a rotor and/or a blank (e.g., an additively manufactured near net component), which will nevertheless incorporate numerous other benefits of the present disclosure, and such manufacturing operations are contemplated herein.

Figure 16:
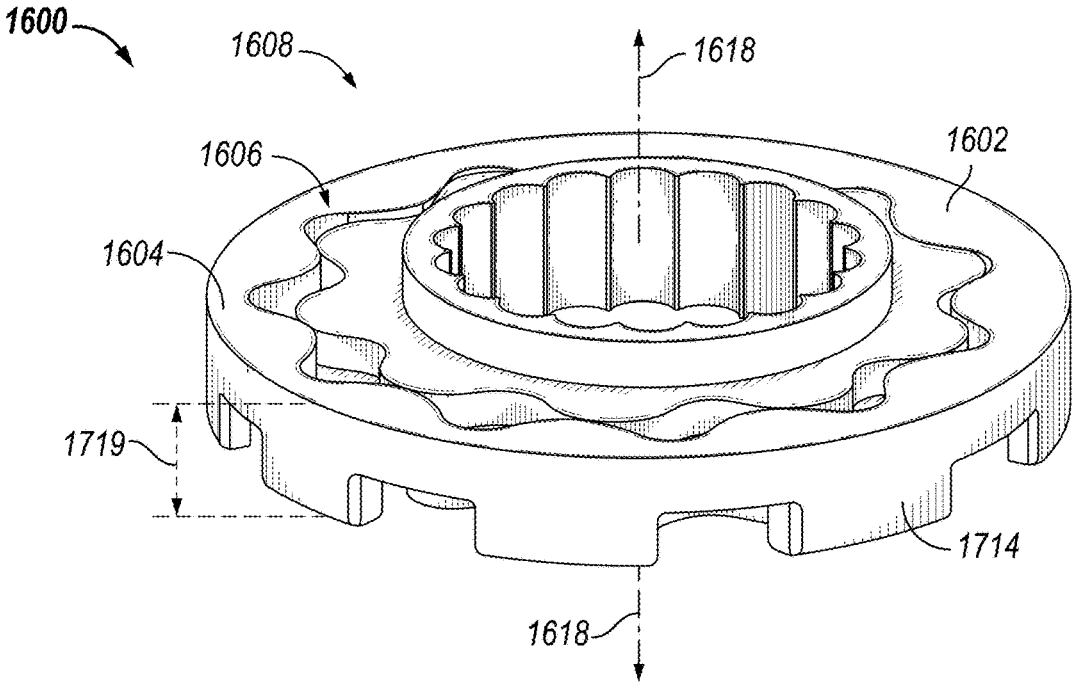
FIG. 16 is a schematic view depicting a gerotor component, in accordance with embodiments of the current disclosure.
Figure 17:
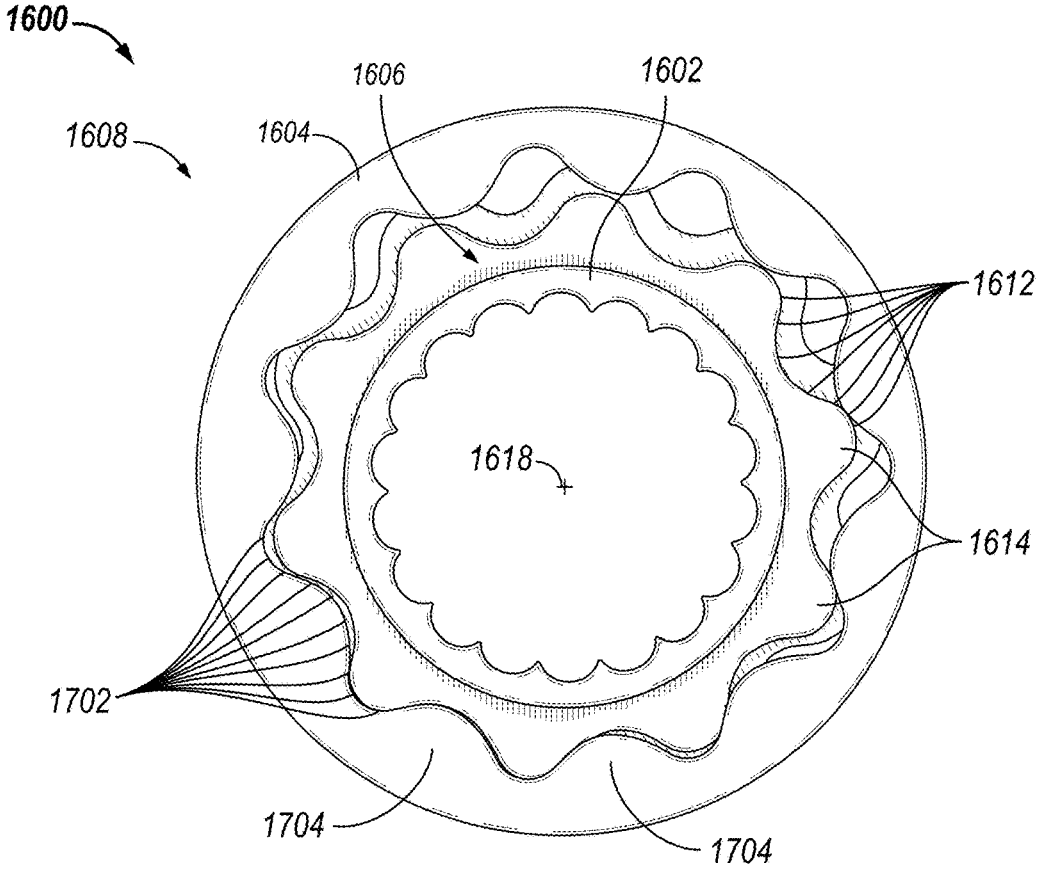
FIG. 17 is another schematic view of the gerotor component of FIG. 16, in accordance with embodiments of the current disclosure.
Figure 18:
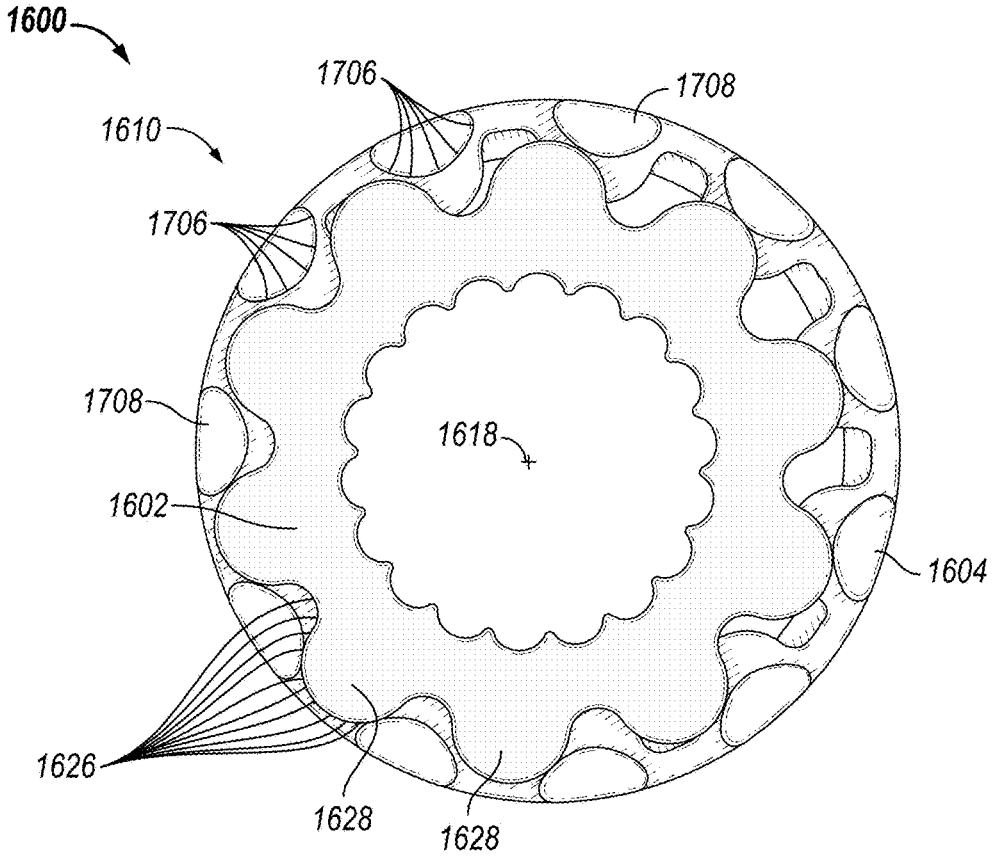
FIG. 18 is another schematic view of the gerotor component of FIG. 16, in accordance with embodiments of the current disclosure.

Referencing FIGS. 16-18, another example gerotor component 1600 for a displacement pump (104 FIG. 1) is depicted having an inner body 1602 and an outer body 1604. The inner body 1602 is disposed within an interior opening 1606 (best seen in FIGS. 22-24) of the outer body 1604 so that the inner body 1602 rotates with respect to the outer body 1604 or vice-versa. In embodiments, the gerotor has a first side 1608 (shown in FIG. 17) and a second side 1610 (shown in FIG. 18).

Figure 19:
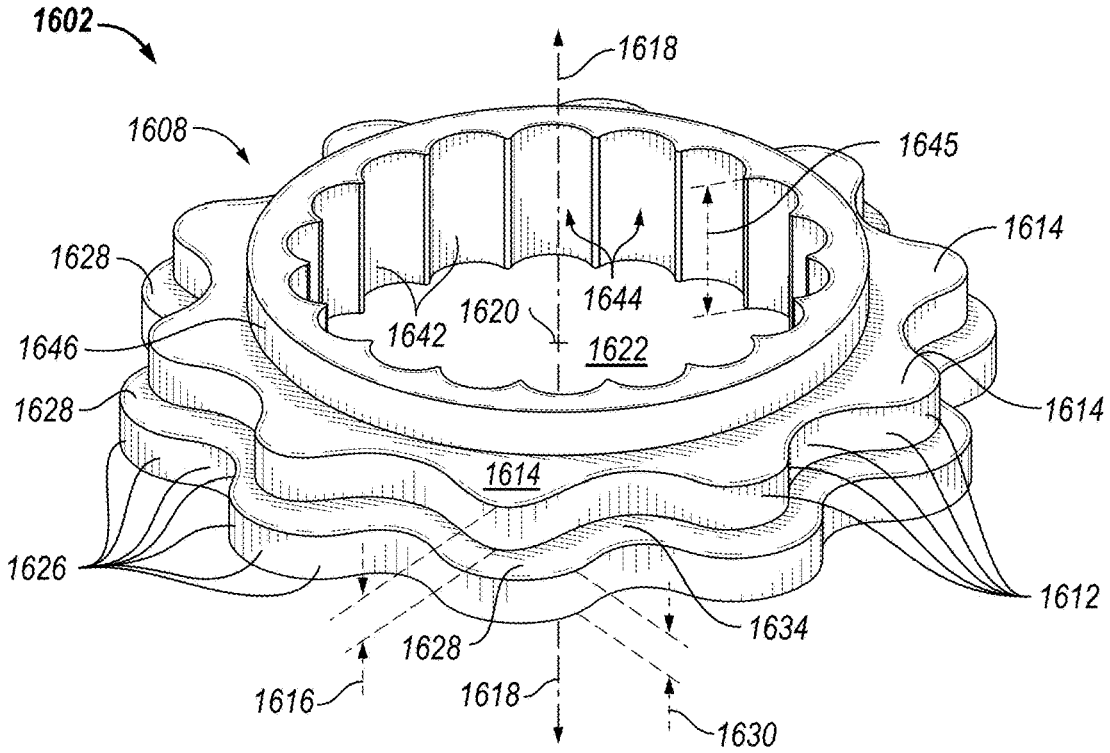
FIG. 19 is a schematic view of an inner body of the gerotor component of FIG. 16, in accordance with embodiments of the current disclosure.
Figure 20:
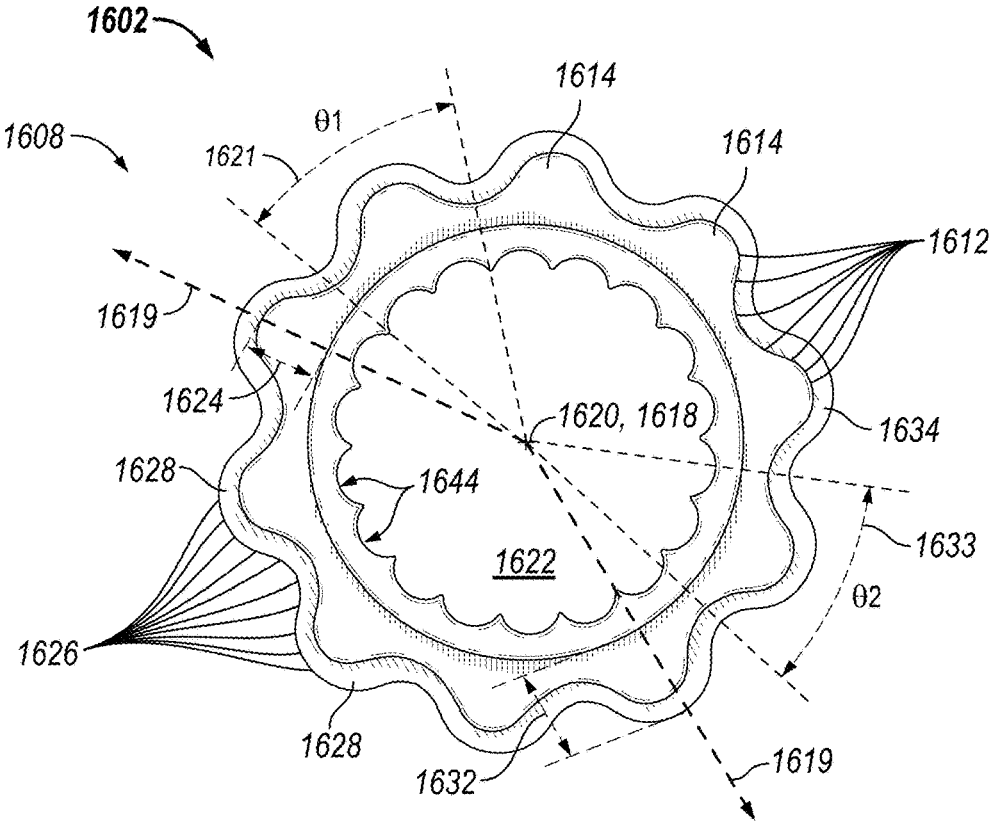
FIG. 20 is another is a schematic view of the inner body of the gerotor component of FIG. 16, in accordance with embodiments of the current disclosure.
Figure 21:
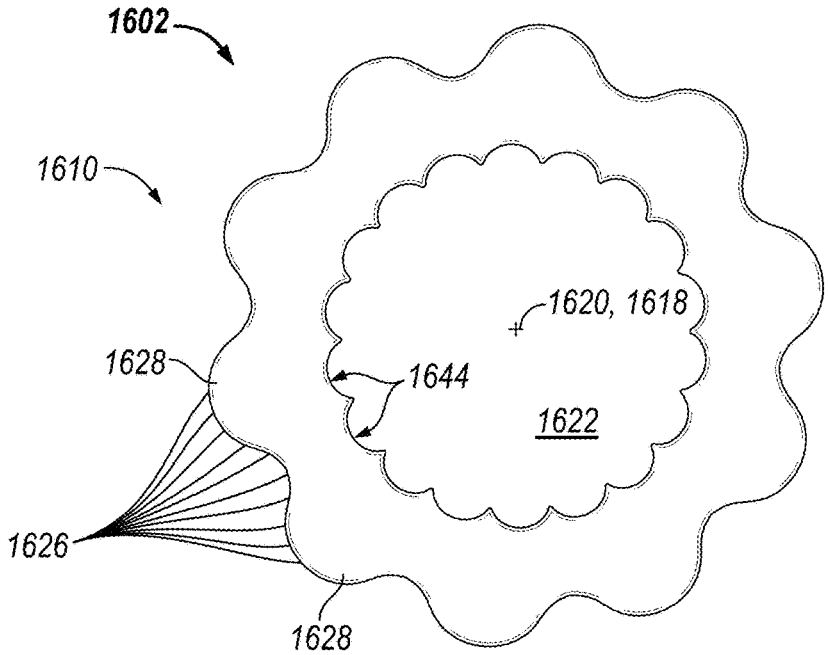
FIG. 21 is another schematic view of the inner body of the gerotor component of FIG. 16, in accordance with embodiments of the current disclosure.

Turning to FIGS. 19-21, the inner body 1602 includes a first inner lobe profile 1612, e.g., contour line, having a first number of lobes 1614, e.g., ten (10). The lobes 1614 have a first axial extent 1616 (best seen in FIG. 19), e.g., the lobes 1614 span a portion of the z-axis 1618 emanating from a center 1620 of an opening 1622 of the inner body 1602. The first axial extent 1616 may range from about 4 to about 18 mm, inclusive. The lobes 1614 also have a first radial extent 1624 (FIG. 20), e.g., the lobes 1614 may span a distance along a corresponding radial 1619 of the inner body 1602 emanating from the center 1620. The first radial extent 1624 may range from about 2 to about 25 mm, inclusive. The lobes 1614 may also have a first azimuthal extent 1621 (FIG. 20). The azimuthal extent may be determined as the angular distance between any two lobes, between two consistent positions on the profile, or the like, and may relate to the actual period of the lobe (e.g., bottom dead center to bottom dead center, or top dead center to top dead center), or to another characteristic angular distance that may be useful to describing pump operations, for example between inflection points (e.g., where the concavity of the profile changes) of the profile 1612. It will be understood that the axial positioning and extent depends upon the number of lobes, for example with ten (10) lobes (e.g., as depicted in the example of FIG. 20) the first azimuthal extent 1621 may be thirty-six (36) degrees (360 degrees/10 lobes) or some lower number (e.g., eighteen (18) degrees between inflection points, depending on the specific geometry of the profiles). The lobes 1614, 1628 may be azimuthally aligned, and the two (or more) lobe profiles 1612, 1626 may share azimuthal characteristics such as the azimuthal extent.

One of skill in the art, having the benefit of the present disclosure, will understand that the utilization of multiple stepped profiles (e.g., two profiles in the example of FIGS. 19-21) allows for an increased equivalent pumping volume for each pumping chamber, for example an increased volumetric difference between the fully open and fully closed position for the pumping chamber, and accordingly allows for increased volumetric flow within the same geometric footprint of a gerotor pump where the stator/rotor elements are replaced with elements of the present disclosure. A moderate step difference between the profiles allows for at least a 15% increase in the pump flow rate for a given pump geometry, and embodiments similar to those depicted in FIGS. 19-21, based upon information and experimentation, appears to increase the pump flow rate by about 30% compared to a previously known stator/rotor element for the gerotor pump. Any ranges and extents set forth herein, for example relating to axial and/or radial extents, are non-limiting examples. Embodiments herein may have rotor/stator sizes configured for any gerotor pump, with the ranges and extents herein scaled accordingly. Certain considerations for determining the ranges and/or extents of the profiles, whether axial, radial, or azimuthal extents, include, without limitation: the remaining outer rotor structural thickness and stress profile after configuring the profiles; the remaining inner rotor structural thickness and stress profile; the size of the footprint available in the installed system (e.g., a vehicle) and any flexibility thereof (e.g., from fully flexible—e.g., fitting a pump into a known region of the vehicle, to fully constrained, e.g., fitting an embodiment rotor/stator set into a fixed housing of a pre-existing gerotor pump); the pressures, flow rates, transient operations, temperatures, viscosities, operating speeds, variability thereof, and/or duty cycle thereof of the pump; the material of the pump and corresponding material characteristics; and/or any manufacturing effects such as tolerances, stresses, and/or surface hardening effects.

The inner body 1602 also includes a second inner lobe profile 1626, e.g., contour line, having the first number of lobes 1628, e.g., ten (10). The lobes 1628 have a second axial extent 1630 (FIG. 19), e.g., the lobes 1628 span a portion of the z-axis 1618 emanating from the center 1620 of the opening 1622 of the inner body 1602. The second axial extent 1630 may range from about 4 to about 18 mm, inclusive. The lobes 1628 also have a second radial extent 1632 (FIG. 20), e.g., the lobes 1628 span a distance along a corresponding radial 1619 of the inner body 1602 with respect to the center 1620. The second radial extent 1632 may range from 2 mm to about 25 mm, inclusive. The lobes 1628 may also have a second azimuthal extent 1633 (FIG. 20), e.g., the angular distance and/or radials $\theta_2$ between any two maxima (or any two minima or any two inflection points) of the profile 1626.

In embodiments, the lobes 1628 of the second inner lobe profile 1626 are azimuthally aligned with the lobes 1614 of the first inner lobe profile 1612, e.g., pairs of lobes 1614 and 1628 are centered along a same radial 1619 emanating from the center 1620 of the opening 1622, as shown in FIG. 20. The lobes 1628 of the second inner lobe profile 1626 may be azimuthally offset from the lobes 1614 of the first inner lobe profile 1612, e.g., pairs of lobes 1614 and 1628 are offset/shifted from each other with respect to the same radial 1619 emanating from the center 1620 of the opening 1622.

In embodiments, the second axial extent 1630 (FIG. 19) is distinct from and adjacent to the first axial extent 1616 (FIG. 19), and/or the second radial extent 1632 (FIG. 20) is greater than the first radial extent 1624 (FIG. 20), e.g., the lobes 1628 "stick-out" past the lobes 1614 so as to form a surface/shelf 1634 (best seen in FIGS. 19 and 20).

In embodiments, the inner body 1602 includes a splined hub 1642 on a radially interior surface 1644 of the inner body 1602 (best seen in FIG. 19). The splined hub 1642 may include a hub axial extent 1645 (FIG. 19), e.g., a length along the z-axis 1618, that defines both the first axial extent 1616 (FIG. 19) and the second axial extent 1630 (FIG. 19). The hub axial extent 1645 may be greater than the combined extent/length of the first axial extent 1616 and the second axial extent 1630, where the hub axial extent 1645 forms a flange 1646 (FIG. 19).

Figure 22:
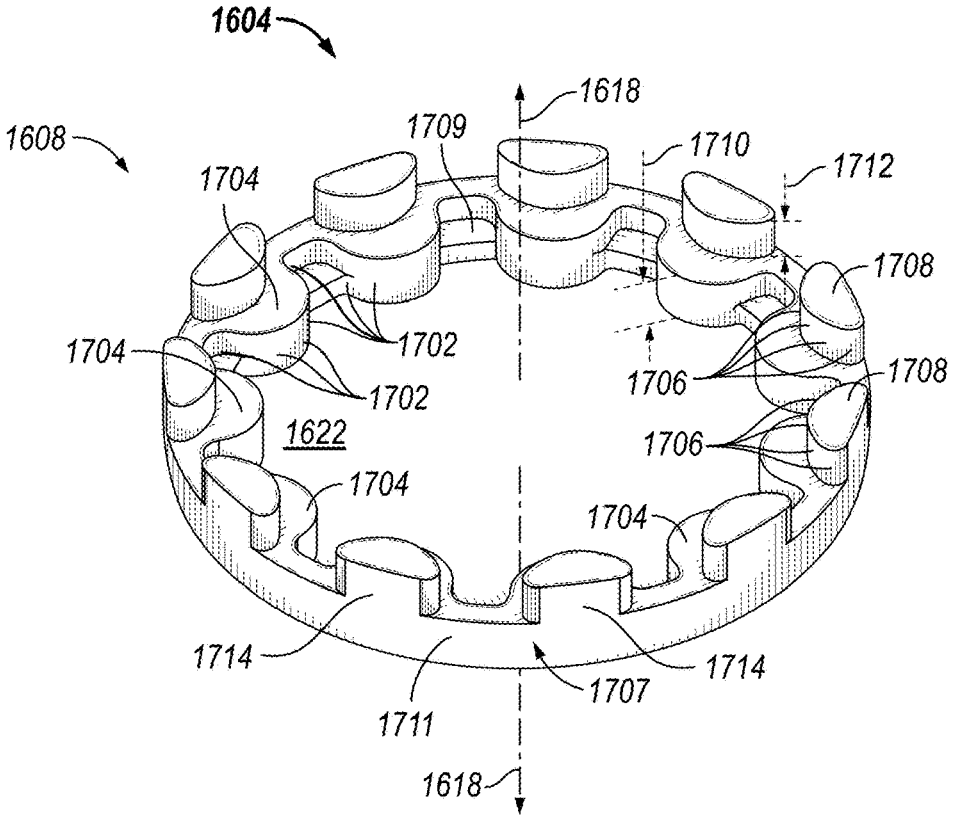
FIG. 22 is a schematic view of an outer body of the gerotor component of FIG. 16, in accordance with embodiments of the current disclosure.
Figure 23:
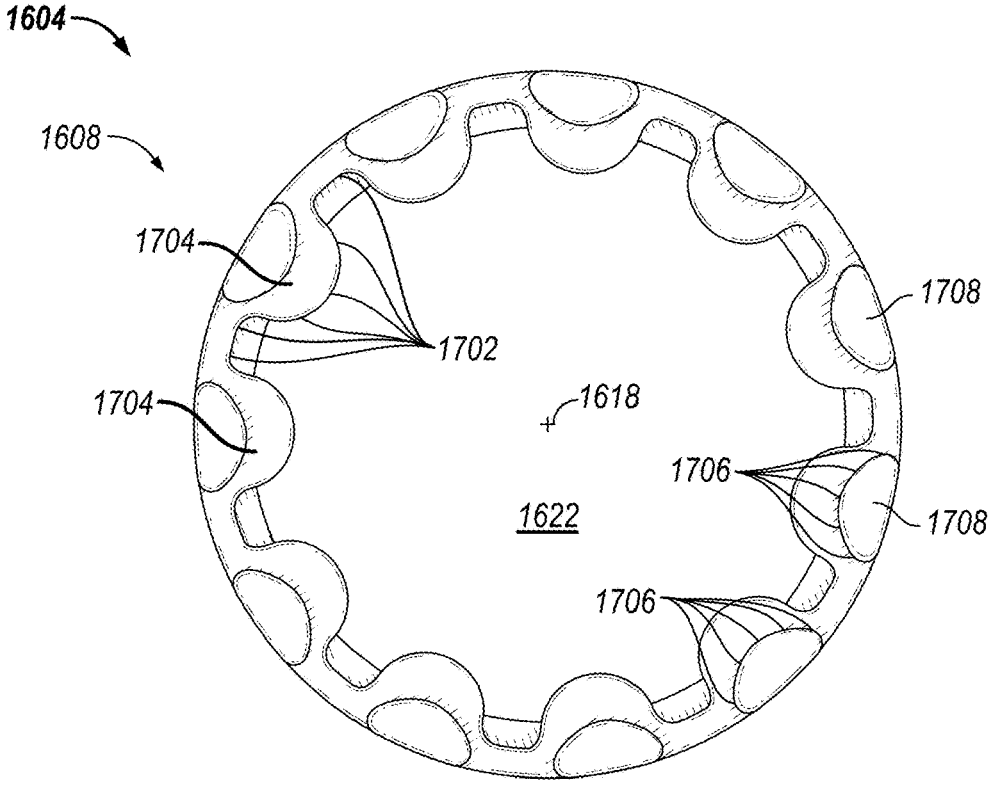
FIG. 23 is another schematic view of the outer body of the gerotor component of FIG. 16, in accordance with embodiments of the current disclosure.
Figure 24:
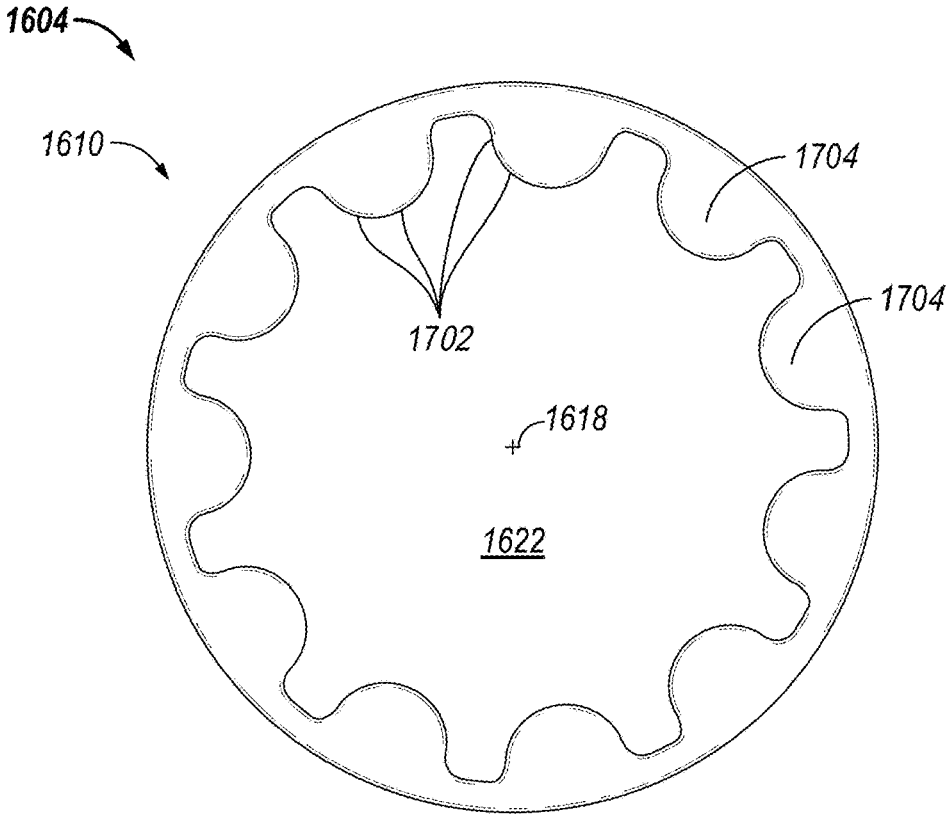
FIG. 24 is another schematic view of the outer body of the gerotor component of FIG. 16, in accordance with embodiments of the current disclosure.

Referencing FIGS. 22-24, the outer body 1604 includes a first outer lobe profile 1702 formed by/having a second number of lobes 1704, e.g., eleven (11), and a second outer lobe profile 1706, e.g., a contour line, formed by/having the second number of lobes 1708, e.g., eleven (11). The first outer lobe profile 1702 may be configured to engage with the first inner lobe profile 1612 (best seen in FIG. 17) and the second out lobe profile 1706 may be configured to engage with the second inner lobe profile 1626 (best seen in FIG. 18). While FIGS. 16-24 depict the first outer lobe profile 1702 as being continuous profile and the second outer lobe profile 1706 as being discontinuous, it is contemplated that either profile 1702 and 1706 may be continuous or discontinuous.

In embodiments, the second number of lobes 1704/1708 is distinct from the first number of lobes 1614/1628, e.g., the second number of lobes 1704/1708 comprises one more lobes 1704/1708 than the first number of lobes 1614/1628. In embodiments, the first number of lobes may range from about six (6) to about twelve (12), and the second number of lobes will generally be one more lobe than the first number of lobes, although other configurations with more outer lobes are possible. In embodiments, the first outer lobe profile 1702 is axially coextensive with the first inner lobe profile 1612, e.g., the lobes 1704 and 1614 have a same height/length along z-axis 1618 (best seen in FIG. 16).

Lobes 1704 and 1708 may extend along the z-axis 1618, e.g., lobes 1704 and 1708 may have respective "heights"/axial extents 1710 and 1712 (FIG. 22). In embodiments, axial extent 1710 and axial extent 1712 may range from about 4 to about 18 mm, inclusive. In embodiments, the second outer lobe profile 1706 is axially coextensive with the second inner lobe profile 1626, e.g., lobes 1708 and 1628 may have a same respective "height"/axial extents 1712 (FIG. 22) and 1630 (FIG. 19). In embodiments, the first outer lobe profile 1702 is axially coextensive with the first inner lobe profile 1612, e.g., lobes 1704 and 1614 may have a same respective "height"/axial extents 1710 (FIG. 22) and 1616 (FIG. 19). The second outer lobe profile 1706 may include a transition surface 1707 between lobes 1704 of the first outer lobe profile 1702 and the second outer lobe profile 1706 (FIG. 22). The transition surface 1707 may include a scallop 1709 on a radially interior portion of the transition surface 1707. In embodiments, the transition surface 1707 may include a constant axial thickness portion on a radially exterior portion of the transition surface 1707. In embodiments, the transition surface 1707 has a chamfer 1711 (shown in FIG. 22) on a radial extreme of the transition surface 1707.

Embodiments of the gerotor component 1600 may have inner lobe profiles 1612 and/or 1626 (best seen in FIG. 19) of a first size, where the outer lobe profiles 1702 and/or 1706 (best seen in FIG. 22) have a second larger size. In embodiments, a gerotor component 1600 with a total axial extent, e.g., 1616+1630 or 1710+1712, of about 25 mm may have a first set of circumferential contours (e.g., 1616 and 1710) with a combined axial extent from about 6 mm to about 20 mm, and a second set of circumferential contours (e.g., 1630 and 1712) with a combined axial extent from about 5 mm to about 19 mm. It is to be understood that embodiments may have combined axial extents with similar proportions and/or ratios.

In embodiments, an axial face of the second inner lobe profile 1626 and an axial face of the first outer lobe profile 1702 form a sealing surface therebetween for a closing chamber formed by the inner lobe profiles engaging the outer lobe profiles. For example, in embodiments, the differential rotation of the inner body 1602 and the outer body 1604 creates a sequence/series of opening/expanding and contracting/closing chambers.

Figure 25:
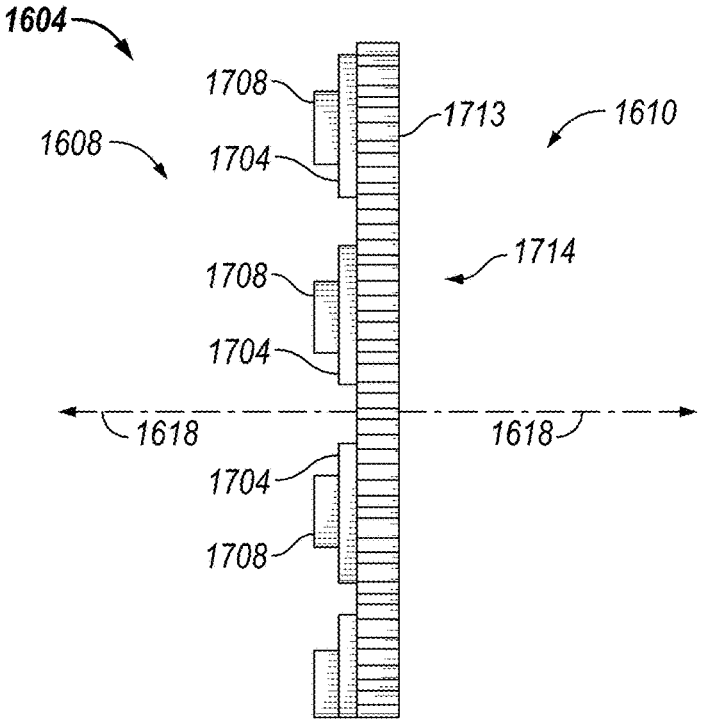
FIG. 25 is a schematic view of another embodiment of the outer body of the gerotor component of FIG. 16, in accordance with embodiments of the current disclosure.

In embodiments, the outer body 1604 further comprises a toothed surface 1713 (FIG. 25) on a radially exterior surface 1714 (FIGS. 16, 22, and 25) of the outer body 1604. The toothed surface may provide for the outer body 1604 to be rotationally powered by an external gear, e.g., the outer body 1604 may be a powered rotor. In embodiments, the toothed surface 1714 may include a surface axial extent 1719 (FIG. 16) defining both axial extent 1710 (FIG. 22) and axial extent 1712 (FIG. 22). The surface axial extent 1719 may be greater than the combined extent of axial extent 1710 and axial extent 1712.

In embodiments, the inner body 1602 may include a rotor and/or the outer body 1604 may include a stator. In embodiments, the outer body 1604 may include a rotor and/or the inner body 1602 may include a stator.

While the example gerotor component 1600 is depicted herein as having two sets of lobe profiles, e.g., 1612 and 16126 (FIG. 19) and 1702 and 1706 (FIG. 22), it is contemplated that embodiments may incorporate three or more sets of lobe profiles. In other words, embodiments of the gerotor component 1600 may include two or more "steps"/"shelves". The number of "steps"/"shelves" may range from about one (1) to about one hundred (100), e.g., three (3), four (4), etc. In certain embodiments, a gerotor component 1600 includes three steps, each azimuthally aligned, axially adjacent, and progressing monotonically in radial position. In certain embodiments, a gerotor component 1600 includes four steps, each azimuthally aligned, axially adjacent, and progressing monotonically in radial position.

As will be appreciated, however, embodiments of the example gerotor component 1600 having two sets of lobe profiles, e.g., 1612 and 16126 (FIG. 19), and 1702 and 1706 (FIG. 22), provide for improved volume throughput, easier manufacturing, and/or improved sealing of the chambers (formed by the rotation of the lobes), as compared to other embodiments which may include higher numbers of lobe profile sets and/or a continuous sloping lobe profile. Further, the profile sets of the inner body 1602 and the outer body 1604 have an interlocking involute gear tooth/lobe profile, which promotes smooth engagement and disengagement during rotation.

Embodiments of the gerotor component 1600 may also provide for an eclipse pump, where the inner 1602 and outer 1604 bodies may be separated by a wedge housing. In such embodiments, the inner body 1602 may be a rotor mounted eccentrically relative to the outer body (which may be a stator), thereby creating an eccentric axis. The interlocking involute gear tooth/lobe profile on the inner body 1602 and outer body 1604 promotes precise meshing and fluid displacement.

An example manufacturing operation includes forming the outer rotor and/or the inner rotor with an extended contact lip, for example at the position of the rotor(s) where contact is made to seal the fluid chambers. The extended contact lip(s) may be formed in the blank, where present, and/or in the rotor(s) after machining operations. In the example, a grinding or other removal operation may be utilized, to remove a designed amount of material from the lip, providing for a single operation that is readily verifiable and repeatable to ensure that the seal is a high quality seal. Based upon experience and testing, such operations to finalize the rotor seals provide for improved final sealing, enhancing the volumetric efficiency of the final gerotor component. Further, the extended lip and grinding operation has been found to further improve sealing in cooperation with rotationally transformed embodiments, further improving the seal integrity. Further still, the extended lip and grinding operation has been found to further improve sealing when utilized with a sintered blank, allowing for a simple closely tolerance tip for sealing. Embodiments herein may utilize a fixed mold for the rotors, with excess length on each side for the lip, which is then ground to finalize the seal. Such operations provide for a highly manufacturable component with high performance for fluid volume throughput and/or volumetric efficiency.

Certain logical groupings of operations herein, for example methods or procedures of the current disclosure, are provided to illustrate aspects of the present disclosure. Operations described herein are schematically described and/or depicted, and operations may be combined, divided, re-ordered, added, or removed in a manner consistent with the disclosure herein. It is understood that the context of an operational description may require an ordering for one or more operations, and/or an order for one or more operations may be explicitly disclosed, but the order of operations should be understood broadly, where any equivalent grouping of operations to provide an equivalent outcome of operations is specifically contemplated herein. For example, if a value is used in one operational step, the determining of the value may be required before that operational step in certain contexts (e.g., where the time delay of data for an operation to achieve a certain effect is important), but may not be required before that operation step in other contexts (e.g. where usage of the value from a previous execution cycle of the operations would be sufficient for those purposes). Accordingly, in certain embodiments an order of operations and grouping of operations as described is explicitly contemplated herein, and in certain embodiments re-ordering, subdivision, and/or different grouping of operations is explicitly contemplated herein.

While the disclosure has been disclosed in connection with certain embodiments shown and described in detail, various modifications and improvements thereon will become readily apparent to those skilled in the art. Accordingly, the spirit and scope of the present disclosure is not to be limited by the foregoing examples but is to be understood in the broadest sense allowable by law.

What is claimed is:

1. A fluid displacement pump, comprising:

an inner body comprising:

a first inner lobe profile comprising a first number of lobes having a first axial extent and a first radial extent; and a second inner lobe profile comprising the first number of lobes having a second axial extent and a second radial extent, wherein:

the lobes of the second inner lobe profile are azimuthally aligned with the lobes of the first inner lobe profile, wherein the second axial extent is distinct from, and adjacent to, the first axial extent, and wherein the second radial extent is greater than the first radial extent; and an outer body, comprising:

a first outer lobe profile comprising a second number of lobes configured to engage with the first inner lobe profile, wherein the second number of lobes is distinct from the first number of lobes, and wherein the first outer lobe profile is axially coextensive with the first inner lobe profile; and a second outer lobe profile comprising the second number of lobes configured to engage with the second inner lobe profile, wherein the second outer lobe profile is axially coextensive with the second inner lobe profile.

2. The fluid displacement pump of claim 1, wherein the second number of lobes comprises one more lobes than the first number of lobes.

3. The fluid displacement pump of claim 1, wherein the inner body further comprises a splined hub on a radially interior surface of the inner body.

4. The fluid displacement pump of claim 3, wherein the splined hub comprises a hub axial extent defining both the first axial extent and the second axial extent.

5. The fluid displacement pump of claim 4, wherein the hub axial extent is greater than the combined extent of the first axial extent and the second axial extent.

6. The fluid displacement pump of claim 1, wherein the outer body further comprises a toothed surface on a radially exterior surface of the outer body.

7. The fluid displacement pump of claim 6, wherein the toothed surface comprises a surface axial extent defining both the first axial extent and the second axial extent.

8. The fluid displacement pump of claim 7, wherein the surface axial extent is greater than the combined extent of the first axial extent and the second axial extent.

9. The fluid displacement pump of claim 1, wherein the inner body comprises a rotor.

10. The fluid displacement pump of claim 1, wherein the outer body comprises a stator.

11. The fluid displacement pump of claim 1, wherein the first outer lobe profile comprises a continuous profile.

12. The fluid displacement pump of claim 11, wherein the second outer lobe profile comprises a discontinuous profile.

13. The fluid displacement pump of claim 12, wherein the second outer lobe profile further comprises a transition surface between lobes of the first outer lobe profile and the second outer lobe profile.

14. The fluid displacement pump of claim 13, wherein the transition surface comprises a scallop on a radially interior portion of the transition surface.

15. The fluid displacement pump of claim 14, wherein the transition surface comprises a constant axial thickness portion on a radially exterior portion of the transition surface.

16. The fluid displacement pump of claim 15, wherein the transition surface comprises a chamfer on a radial extreme of the transition surface.

17. The fluid displacement pump of claim 1, wherein an axial face of the second inner lobe profile and an axial face of the first outer lobe profile form a sealing surface therebetween for a closing chamber formed by the inner lobe profiles engaging the outer lobe profiles.

18. A method comprising:

pumping at least one of a fluid or a gas with a pump, the pump comprising:

an inner body comprising:

a first inner lobe profile comprising a first number of lobes having a first axial extent and a first radial extent; and a second inner lobe profile comprising the first number of lobes having a second axial extent and a second radial extent, wherein:

the lobes of the second lobe profile are azimuthally aligned with the lobes of the first lobe profile, wherein the second axial extent is distinct from, and adjacent to, the first axial extent, and wherein the second radial extent is greater than the first radial extent; and an outer body, comprising:

a first outer lobe profile comprising a second number of lobes configured to engage with the first inner lobe profile, wherein the second number of lobes is distinct from the first number of lobes, and wherein the first outer lobe profile is axially coextensive with the first inner lobe profile; and a second outer lobe profile comprising the second number of lobes configured to engage with the second inner lobe profile, wherein the second outer lobe profile is axially coextensive with the second inner lobe profile.

19. The method of claim 18, wherein the second number of lobes comprises one more lobe than the first number of lobes.

20. The method of claim 19, wherein the inner body further comprises a splined hub on a radially interior surface of the inner body.

* * * * *